United States Patent [19]

Forrester

[11] Patent Number: 4,500,005

[45] Date of Patent: Feb. 19, 1985

[54] TAMPER-EVIDENT CAP ASSEMBLY FOR A CONTAINER

[76] Inventor: Jerry Forrester, 132 Greenwood Village, Sherwood Park, Alberta, Canada, T8A 0Z8

[21] Appl. No.: 588,837

[22] Filed: Mar. 12, 1984

[51] Int. Cl.[3] ..... B65D 55/02; B65D 85/56; A61J 1/00

[52] U.S. Cl. ..... 215/203; 215/219; 215/220

[58] Field of Search ..... 215/203, 216, 218, 219, 215/220, 221

[56] References Cited

U.S. PATENT DOCUMENTS

| | | | |
|---|---|---|---|
| 4,319,690 | 3/1982 | Birrell et al. | 215/220 |
| 4,446,979 | 5/1984 | Gach et al. | 215/203 |
| 4,454,955 | 6/1984 | Kusz et al. | 215/220 |

*Primary Examiner*—George T. Hall
*Attorney, Agent, or Firm*—Robert F. Delbridge; Arne I. Fors

[57] ABSTRACT

A tamper-evident cap assembly for a container with an externally screw-threaded top has an inner cap having an annular wall and an open lower end, the annular wall having an internal screw-thread to enable the inner cap to be screwed onto the top of the container by clockwise movement of the inner cap relative to the container. An outer cap has an annular wall, a closed upper end and an open lower end, the outer cap being fitted over the inner cap and retained in assembly with the inner cap. The annular walls of the inner and outer caps have mutually-engaging screw-threads to cause initial anticlockwise turning movement of the outer cap to result in angular movement of the outer cap relative to the inner cap. The inner and outer caps have cooperating ratchets to cause clockwise movement of the outer cap to be transmitted to the inner cap while permitting anticlockwise movement of the outer cap relative to the inner cap. The closed end of the outer cap has a window and the inner cap has an insignia which is not visible in the window when the outer cap is in an initial relatively clockwise position relative to the inner cap and which is visible when the outer cap has been turned in an initial anticlockwise movement relative to the inner cap.

8 Claims, 6 Drawing Figures

FIG. 1.
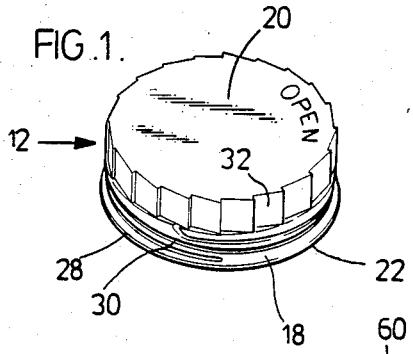
FIG. 2.
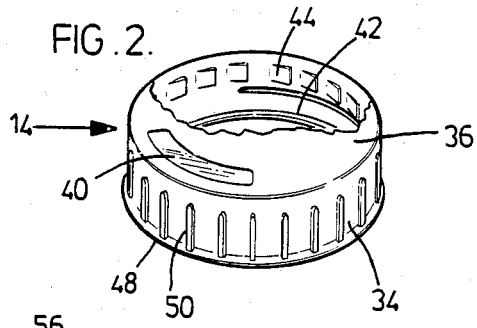
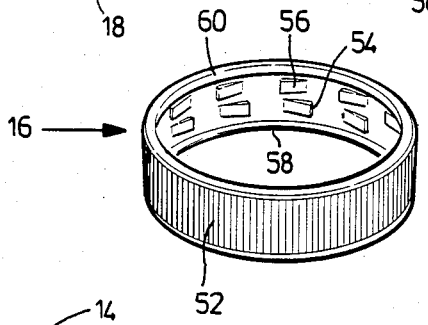
FIG. 3.
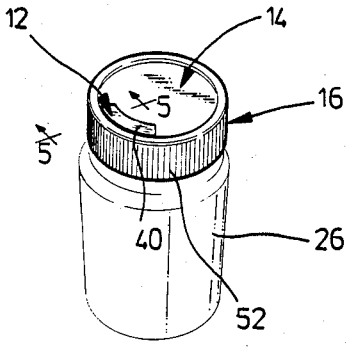
FIG. 4.
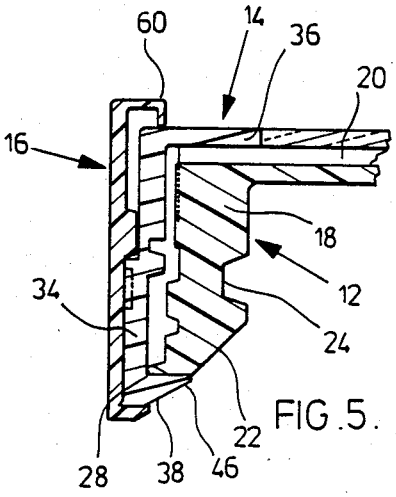
FIG. 5.
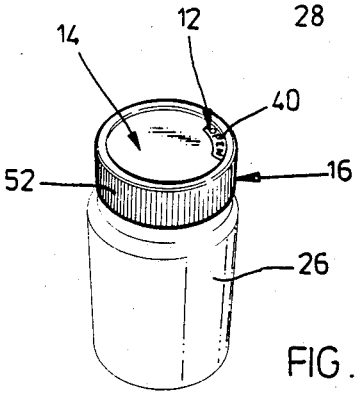
FIG. 6.

TAMPER-EVIDENT CAP ASSEMBLY FOR A CONTAINER

This invention relates to tamper-evident cap assemblies for containers with externally screw-threaded tops, for example glass or plastic bottles.

Many attempts have been made to provide satisfactory tamper-resistant cap assemblies for glass or plastic containers, but there is still a need for a simple, inexpensive cap assembly which clearly indicates if an attempt has been made to open the container.

It is therefore an object of the invention to provide an improved tamper-evident cap assembly for such containers.

According to the invention, a cap assembly includes an inner cap having an annular wall and an open lower end, the annular wall having an internal screw-thread to enable the inner cap to be screwed onto the top of the container by clockwise movement of the inner cap relative to the container, an outer cap having an annular wall, a closed upper end and an open lower end, the outer cap being fitted over the inner cap, with means retaining the outer cap in assembly with the inner cap. The annular walls of the inner and outer caps have mutually-engaging screw-threads to cause initial anticlockwise movement of the outer cap to result in angular movement of the outer cap relative to the inner cap. The inner and outer caps having cooperating ratchet means to cause clockwise movement of the outer cap to be transmitted to the inner cap while permitting anticlockwise movement of the outer cap relative to the inner cap. The closed end of the outer cap has a window and the inner cap has insignia which is not visible in the window when the outer cap is in an initial relatively clockwise position relative to the inner cap and which is visible when the outer cap has been turned in an intial anticlockwise movement relative to the inner cap.

Thus, the outer cap is initially assembled with the inner cap in a relatively clockwise position relative to the inner cap, and the cap assembly can be screwed onto a container by clockwise movement of the outer cap which is transmitted to the inner cap. In this position, the insignia on the inner cap is not visible in the window of the outer cap. In any attempt to open the container, the outer cap will be turned in an unscrewing direction, i.e. anticlockwise. Such movement will initially result in the outer cap being rotated relative to the inner cap to cause the insignia on the inner cap to appear in the window of the outer cap. The appearance of such insignia indicates that an attempt to open the container has been made. The insignia may for example simply consist of the word OPEN. Once this movement has been made, it cannot be reversed since such reverse movement is prevented by the ratchet means. Thus, once an attempt has been made to open the container, the insignia will remain visible in the window in the outer cap.

The means retaining the cap in assembly with the inner cap may comprise inwardly projecting means at the lower end of the angular wall of the outer cap snapped over the lower end of the annular wall of the inner cap. The cooperating ratchet means may be located on the annular walls of the inner and outer caps, and the inner cap may have a closed end with the insignia being located thereon.

The mutual engaging screw-threads may cause initial anticlockwise movement of the outer cap relative to the inner cap to result in angular and descending movement of the outer cap relative to the inner cap.

The cap assembly may also include a child-resistant opening member, the opening member having an annular wall surrounding the annular wall of the outer cap, a resilient flange at the upper end of the annular wall of the opening member projecting inwardly over at least the annular wall of the outer cap, and means retaining the opening member in engagement with the outer cap. The inner wall of the opening member may have lower ratchet means coorporating with means on the annular wall of the outer cap to cause clockwise movement of the opening member to be transmitted to the outer cap while permitting anticlockwise movement of the opening member relative to the outer cap. The inner wall of the opening member also has upper ratchet means normally disengaged from the outer cap to cause anticlockwise movement of the opening member not to be transmitted to the outer cap, the opening member being movable downwardly relative to the outer cap by resilient deformation of the flange to cause the upper ratchet means to cooperate with means on the annular wall of the outer cap and transmit anticlockwise movement of the opening member to the outer cap.

The means retaining the opening member in engagement with the outer cap may comprise inwardly projecting means at the lower end of the annular wall of the opening member snapped over the lower end of the annular wall of the outer cap.

The means on the annular wall of the outer cap may comprise peripherally spaced rib means engageable with the lower ratchet means of the opening member when the opening member is turned clockwise and engageable with the upper ratchet means of the opening member only when the opening member is moved downwardly relative to the outer cap and turned anticlockwise.

One embodiment of the invention will now be described, by way of example, with reference to the accompanying drawing, of which:

FIG. 1 is a perspective view of the inner cap of a tamper-evident child resistant cap assembly, FIG. 2 is a similar view, but partly broken away, of the outer cap, FIG. 3 is a perspective view of the child resistant opening member, FIG. 4 is a perspective view of the cap assembly screwed onto a container, FIG. 5 is a sectional view of the cap assembly taken along the line 5-5 of FIG. 4, and FIG. 6 is a similar view to FIG. 4 but showing the insignia indicating that an attempt to open the container has been made.

Referring to the drawing, a tamper-evident child resistant cap assembly comprises an inner cap 12, and an outer cap 14 and a child resistant opening member 16, each molded from a suitable synthetic plastic material. The inner cap 12 has an annular wall 18, an upper closed end 20 and a lower open end 22. The annular wall 18 has an internal screw-thread 24 to enable the inner cap 12 to be screwed onto an external screw-thread (not shown) on the top of a plastic bottle-like container 26.

Inner cap 12 also has a slightly outwardly projecting annular rim 28 at the lower end of the annular side wall 18. Above the rim 28, the lower part of the outer surface of the annular wall 18 has a left hand screw-thread 30, and the upper part has a series of circumferentially extending ratchet teeth 32 facing in an anticlockwise direction. The upper surface of the closed end 20 has the word OPEN marked thereon near the outer edge.

The outer cap 14 has an annular wall 34, a closed upper end 36 and a lower open end 38, the closed upper end 36 having an arcuate window 40. The annular wall 34 has a left hand screw thread 42 on the lower part of its inner surface, and a series of circumferentially extending ratchet teeth 44 on the upper part of its inner surface, the ratchet teeth 44 on the upper part of its inner surface, the ratchet teeth 44 facing in a clockwise direction.

The outer cap 14 also has an inwardly projecting annular lip 46 and a slightly outwardly projecting annular rim 48 at its lower end. The outer surface of the annular wall 34 has a series of circumferentially spaced ribs 50 extending upwardly from the lower end of the annular wall 34 to a position near but spaced from the top of the annular wall 34.

The child resistant opening member 16 has an annular wall 52 with a knurled outer surface to facilitate gripping by a hand, and an inner surface with upper and lower series of circumferentially-extending ratchet teeth 54, 56 respectively. The lower ratchet teeth 54 face in a clockwise direction and the upper ratchet teeth 56 face in an anticlockwise direction. The lower end of the annular wall 52 has an inwardly projecting annular ledge 58, and the upper end of the annular wall 52 has an inwardly projecting resilient lip 60 with a downwardly extending free end portion.

To assembly the various parts, the outer cap 14 is fitted over the inner cap 12 by causing the inwardly projecting lip 46 to snap under the lower end of the annular wall 52 with the inner cap 12, at the same time snapping the screw-thread 42 on the inner surface of the annular wall 34 of the outer cap 14 passed and in engagement with the screw-thread 30 on the outer surface of the annular wall 18 of the inner cap 12. Before the snapping engagement between the outer cap 14 and the inner cap 12 is effected, the outer cap 14 is angularly oriented relative to the inner cap 12 so that the window 40 and the outer cap 14 are displaced in an clockwise direction from the word OPEN on the inner cap 12, so that the word OPEN is not visible in the window 40 as indicated in FIG. 4.

The child resistant opening member 16 is then fitted over the outer cap 14 by causing the newly projecting ledge 58 to snap under the lower end of the annular wall 34 of the outer cap 14. The free end portion of the annular lip 60 then engages the upper closed end 36 of the outer cap 14 in the region of the annular wall 34, so that the lower ratchet 54 are engaged with the ribs 50, with the upper ratchet teeth 56 being above the ribs 50.

The completed cap assembly can then be screwed onto the container 26 by clockwise movement of the opening member 16. Such movement is transmitted to the outer cap 14 by the lower ratchet teeth 54 and ribs 50, and to the inner cap 12 by the ratchet teeth 40 and 32.

To open the cap assembly, the opening member is first pressed downwardly, by deflection of the angular lip 60, to cause the upper ratchet teeth 56 to engage the ribs 50. Consequent anticlockwise movement of the opening member 16 is then transmitted to the outer cap 14 by the upper ratchet teeth 56 and ribs 50. If the opening member 16 is not first pushed downwardly, consequent anticlockwise movement is not transmitted to the outer cap 14, thereby providing a child resistant feature.

Initial anticlockwise movement of the outer cap 14 causes relative movement of the left-hand threads 42, 30 so that the outer cap 16 moves angularly and downwardly relative to the inner cap 12 to move the window 40 in the outer cap 16 over the word OPEN on the inner cap 12. At this position, the closed end 36 of the outer cap 14 engages the upper end of the inner cap 12 so as to prevent further clockwise movement of the outer cap 14 relative to the inner cap 12. Once this movement has been effected, the outer cap 14 cannot be turned clockwise relative to the inner cap 12 to cause the word OPEN to disappear from the window 40 because such movement is prevented by ratchet teeth 44, 32. Thus, a positive indication is given that an attempt to open the container has been made.

Consequent anticlockwise movement of the outer cap 14 is then transmitted to the inner cap 12, with the result that the inner cap 12 is then unscrewed from the container 36. The cap assembly can be replaced on the container 26, with the word OPEN continuing to appear in the window 40.

The child resistant opening member 16 may be omitted if desired. Other embodiments will be readily apparent to a person skilled in the art, the scope of the invention being defined in the appended claims.

What I claim as new and desire to protect by Letters Patent of the United States is:

1. A tamper-evident cap assembly for a container with an externally screw-threaded top, the cap comprising:

an inner cap having an annular wall and an open lower end, said annular wall having an internal screw-thread to enable the inner cap to be screwed onto the top of the container by clockwise movement of the inner cap relative to the container, an outer cap having an annular wall, a closed upper end and an open lower end, said outer cap being fitted over the inner cap, means retaining the outer cap in assembly with the inner cap, the annular walls of the inner and outer caps having mutually-engaging screw-threads to cause initial anticlockwise turning movement of the outer cap to result in angular movement of the outer cap relative to the inner cap, the inner and outer caps having cooperating ratchet means to cause clockwise movement of the outer cap to be transmitted to the inner cap while permitting anticlockwise movement of the outer cap relative to the inner cap, the closed end of the outer cap having a window and the inner cap having insignia which is not visible in the window when the outer cap is in an initial relatively clockwise position relative to the inner cap and which is visible when the outer cap has been turned in an initial anticlockwise movement relative to the inner cap.

2. A cap assembly according to claim 1 wherein said means retaining the outer cap in assembly with the inner cap comprises inwardly projecting means at the lower end of the annular wall of the outer cap snapped over the lower end of the annular wall of the inner cap.

3. A cap assembly according to claim 1 wherein said cooperating ratchet means are located on the annular walls of the inner and outer caps.

4. A cap assembly according to claim 1 wherein the inner cap has a closed end, said insignia being located thereon.

5. A cap assembly according to claim 1 wherein said mutually engaging screw-threads cause initial and anticlockwise movement of the outer cap relative to the inner cap to result in angular and descending movement of the outer cap relative to the inner cap.

6. A cap assembly according to claim 1 also including a child-resistant opening member, said opening member having an annular wall surrounding the annular wall of the outer cap, a resilient flange at an upper end of the annular wall of the opening member projecting inwardly over at least the annular wall of the outer cap, means retaining the opening member in assembly with the outer cap, the inner wall of the opening member having lower ratchet means cooperating with means on the annular wall of the outer cap to cause clockwise movement of the opening member to be transmitted to the outer cap while permitting anticlockwise movement of the opening member relative to the outer cap, and the inner wall of the opening member having upper ratchet means normally disengaged from the outer cap to cause anticlockwise movement of the opening member not to be transmitted to the outer cap, said opening member being moveble downwardly relative to the outer cap by resilient deformation of said flange to cause said upper ratchet means to cooperate with means mounted on the outer wall of the outer cap and transmit anticlockwise movement of the opening member to the outer cap.

7. A cap assembly according to claim 6 wherein the means retaining the opening member in assembly with the outer cap comprises an inwardly projecting rim at the lower end of the annular wall of the opening member snapped over the lower end of the annular wall of the outer cap.

8. A cap assembly according to claim 6 wherein said means on the annular wall of the outer cap comprises a peripherally spaced rib means engageable with the lower ratchet means of the opening member when the opening member is turned clockwise, and engageable with the upper ratchet means of the opening member only when the opening member is moved downwardly and turned anticlockwise relative to the outer member.

* * * * *